US005385504A

United States Patent [19]

Hussey et al.

[11] Patent Number: 5,385,504

[45] Date of Patent: Jan. 31, 1995

[54] PERMANENT VENTILATION SEAL

[75] Inventors: David A. Hussey, Monroeville, Pa.; Fred Stafford, III, Newell, W. Va.

[73] Assignee: Earth Support Systems, Glassport, Pa.

[21] Appl. No.: 113,860

[22] Filed: Aug. 30, 1993

[51] Int. Cl.[6] ..... E21F 1/00; E21F 3/00; E02D 3/02

[52] U.S. Cl. ..... 454/169; 405/275; 405/286

[58] Field of Search ..... 454/169; 405/285, 286, 405/287, 275, 267, 132, 150

[56] References Cited

U.S. PATENT DOCUMENTS

| | | | |
|---|---|---|---|
| 3,927,719 | 12/1975 | Maser | 169/46 |
| 4,055,074 | 10/1977 | Thimons et al. | 454/169 |
| 4,237,182 | 12/1980 | Fulmer et al. | 169/64 |
| 4,516,879 | 5/1985 | Berry et al. | 454/169 |
| 4,707,962 | 11/1987 | Meheen | 405/275 |
| 5,174,688 | 12/1992 | Meheen | 405/286 |

OTHER PUBLICATIONS

RI 9382–Report of Investigations/1991 U.S. Department of Interior (Bureau of Mines) Evaluation of Solid-Block and Cementitious Foam Seals.

*Primary Examiner*—Henry C. Yuen
*Attorney, Agent, or Firm*—Buchanan Ingersoll

[57] ABSTRACT

A mine seal is provided in which two walls are constructed across the mine entry. One of the walls is constructed in layers. After a lower portion of the layered wall is erected, a first layer of gravel is provided between the walls. The gravel is then saturated with a binding material such as a polyurethane composition so that the binding material fills the voids between the gravel particles. Additional layers of gravel subsequently saturated with the binding material are provided until the gravel layer is equal in height to the lower portion of the layered wall. The layered wall is then further erected and the process continues until the layered wall is completely constructed and the binding material-saturated filler material emplaces the mine roof. Finally, the exposed surface of the exposed wall is coated with a sealant. Alternatively, the binding material and filler material can be pre-mixed and injected into the space between the two walls. If desired, binding material alone can be inserted between the two walls.

7 Claims, 2 Drawing Sheets

PERMANENT VENTILATION SEAL

BACKGROUND OF THE INVENTION

1. Field of the Invention

The present invention relates to the field of isolation seals for mining applications and, more particularly, to a method of constructing a permanent seal or partition in underground mine workings to isolate the atmosphere on one side of the seal from that on the other side.

2. Description of the Prior Art

In mining underground, there is often a need to separate the atmosphere in one part or area of the mine workings from another part or to isolate an atmosphere in a specific part of the mine workings. This separation is desirable to seal off areas of the mine to limit the area of mine workings needed to be ventilated, to control the dissemination of toxic or explosive gases in the mine, or to allow the atmosphere in an isolated part of the mine to change its composition to a less hazardous state. Seals are constructed across individual tunnels or entries to provide this isolation.

Seals have traditionally been constructed of wood or concrete blocks or poured or pumped cementitious materials of various densities and thicknesses. Unfortunately, because it is difficult to precisely fit wooden or concrete blocks to the irregular surfaces of the tunnel or entry, such designs do not provide a good seal between the structure and the ribs, floor and roof of the mine tunnel or entry. Moreover, because concrete or cementitious materials tend to shrink slightly upon hardening, gaps are formed between the seal structure and the mine opening. The poor seals provided by these traditional designs permit the continual exchange of the atmosphere from one side of the seal to the other. Consequently, there is a need for an improved mine seal that provides complete isolation and separation of the atmosphere on the opposing sides thereof.

SUMMARY OF THE INVENTION

A permanent mine seal is provided which uses a highly expansive binding material, such as closed-cell polyurethane foam, in the center of the seal. This binding material expands to fill all voids associated with the irregular opening of the mine opening. The highly expansive nature of the binding material, coupled with its closed-cell structure, assures a good hermetic seal between the seal structure and the mine opening. Moreover, the adhesion of the binding material to the rest of the seal structure and to the surrounding tunnel surface provides additional strength to the seal structure, an important consideration in satisfying Mine Safety and Health Administration (MSHA) guidelines. Alternatively, the binding material can be used alone without the filler material.

The mine seal of the present invention is formed by erecting a first wall across the mine entry. A second wall, spaced apart from the first wall, is then erected across the mine entry. This second wall is constructed in layers. After a lower portion of the second wall is first erected across the mine entry, a first layer of filler material, such as gravel, is provided between the first wall and the lower portion of the second wall. The filler material is then saturated with a binding material such that the binding material fills the voids between the filler material particles. Additional layers of filler material which are subsequently saturated with the binding material are provided until the gravel layer is equal in height to the lower portion of the second wall. The second wall is then further erected and the process continues until the second wall is completely constructed and the binding material emplaces the mine roof. Finally, the exposed surface of the second wall is coated with a sealant.

In an alternative method of forming a mine seal, a front wall and a back wall are constructed simultaneously. A mixture of the filler material and binding material is then injected into the space between the front and back walls. Gaps are provided in the front wall for the mixture to be injected therethrough. The mixture may be injected at several locations to provide complete filling of the space between the walls. After the mixture has been injected, the front wall is closed and the exposed surface of the front wall is coated with a sealant.

DETAILED DESCRIPTION OF THE PREFERRED EMBODIMENTS

The permanent ventilation mine seal of the present invention utilizes a binding material, such as a closed-cell polyurethane foam, acting in combination with a filler material to form a structural and permanent mine seal. Two concrete block walls are erected across a mine entry. Filler material which has been saturated with the binding material is provided between the two walls. The binding material-saturated filler material adheres to the concrete block walls as well as to the ribs, floor, and roof of the mine entry. A structural mine seal is thereby formed which includes not only the binding material. saturated filler material but also the concrete block walls. In addition to closed-cell polyurethane foam, other binding materials such as other plastics, polymeric foams, and synthetic foams can be used in the present invention.

Figure 1:
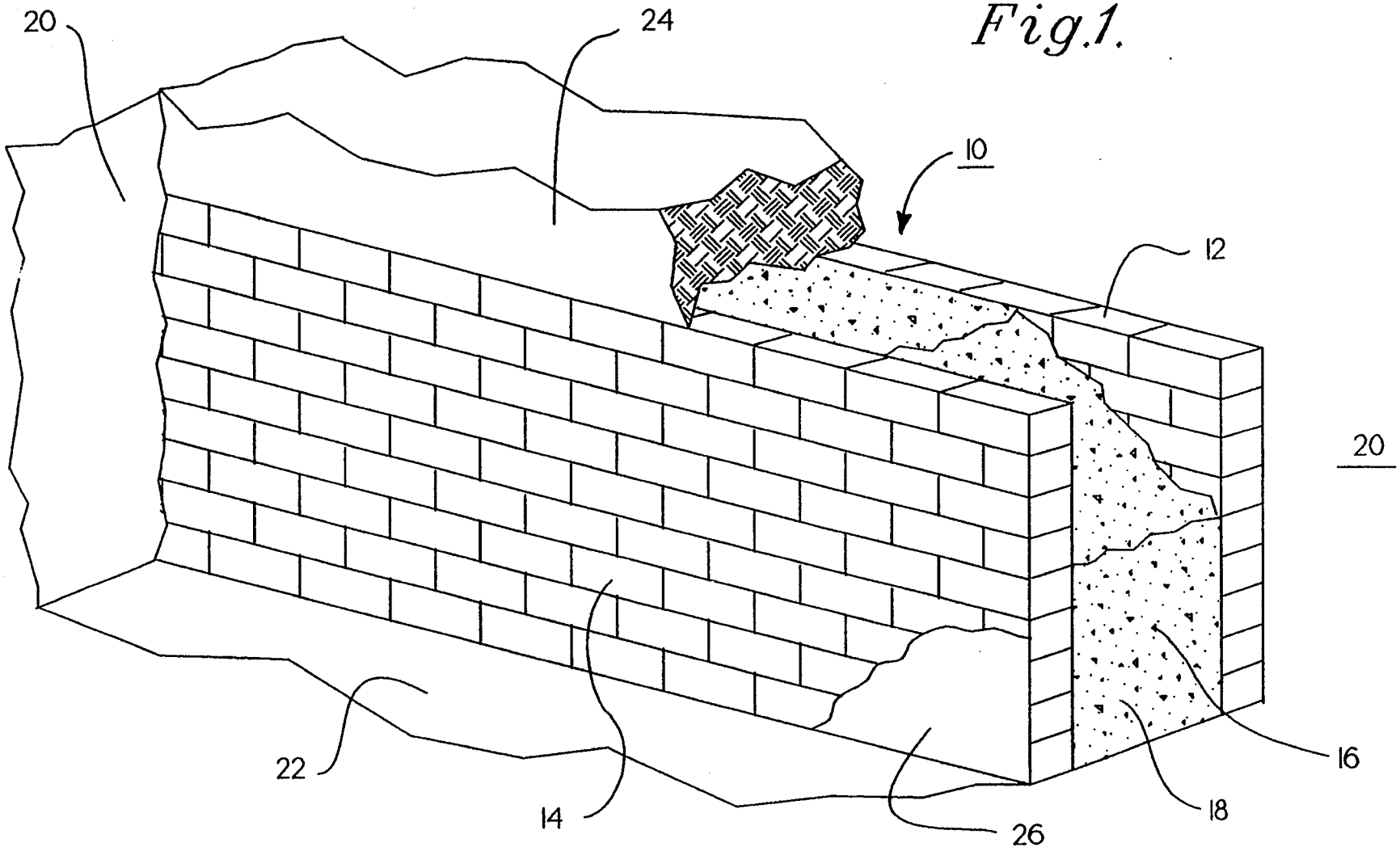
FIG. 1 is an isometric view, partially in section, of the presently preferred embodiment of the permanent ventilation seal in accordance with the present invention.

FIG. 1 shows the basic method of construction of the mine seal of the present invention. As shown in the figure, seal 10 is constructed by first erecting wall 12 of concrete block or equivalent material. Concrete block wall 12 is constructed across the mine entry. The outside surface of wall 12 is preferably covered with a coating of an MSHA-approved sealant such as A-100 Mine Sealant manufactured by Austin Industrial Coatings Corporation of Pittsburgh, Pa. Other sealants listed on the MSHA Suitable Surface Bonding Products For Dry-Stacked Block Stoppings schedule can be used.

After wall 12 is constructed, the first one to two feet of wall 14 is constructed out of concrete block or equivalent material. A six inch layer of gravel 16 or other equivalent filler material is then placed between walls 12 and 14. Gravel 16 is then saturated with a binding material 18 such as a closed-cell polyurethane composition. Binding material 18 fills the voids between the gravel particles 16 and binds to walls 12 and 14 as well as the ribs 20 and floor 22 of the mine entry. This process is then repeated until the gravel 16 and binding material 18 composition are just below the initial height of front wall 14. At this time, an additional two feet of wall 14 is constructed and more gravel 16 and binding material 18 are added as described above. This sequence continues until wall 14 is completely constructed and the gravel 16 and binding material 18 emplace the mine roof 24. Once the seal 10 has been constructed, the outside surface of wall 14 is coated with an MSHA-approved sealant 26 as discussed above.

Although polyurethane foam has been used in seal construction in a limited number of cases in the past, these prior seals differ from the seal of the present invention. These prior seals typically consisted of a ten foot thickness of gravel which was injected with polyurethane foam. Usually, concrete block walls were erected on either side of the seal after the seal was formed in order to provide a cosmetic effect to the seal. Because these block walls were cosmetic rather than structural, no attempt was made to bond the polyurethane/gravel fill to the block walls or to incorporate the block walls as structural members of the seal. Moreover, these prior art seals relied upon the mass of the gravel to provide resistance to movement. No effort was made to adhere the polyurethane composition to the mine opening. The polyurethane composition in the prior mine seals was injected into the gravel by pipes rather than controlled layer spraying of the gravel as it is emplaced. Because of this manner of constructions, the prior seals were not designed to withstand a 20 psi static overpressure as currently required by Federal regulations. The mine seal of the present invention satisfies these current Federal regulations.

Because the polyurethane composition was injected into the gravel by pipes, no attempt was made in these prior art mine seals to insure even and full saturation of the gravel with polyurethane. Moreover, no attempt was made to insure adhesion between the gravel mass and the surfaces of the mine opening. Furthermore, the prior designs did not address the current requirements of ASTM 119 regarding flame resistance.

Unlike the mine seals of the prior art, present mine seal 10 provides a tight seal with the mine entry. The binding material 18 used in seal 10 provides a tight hermetic seal around the perimeter of the seal structure 10 which greatly impedes the movement of the mine atmosphere from one side of seal 10 to the other. Seal 10 uses the adhesion of the binding material 18 to bond the structure together. In addition, seal 10 uses the adhesion of the binding material 18 to bond the structure to the mine opening, thereby eliminating the need for mechanical anchoring of the structure to or into the surrounding rock that is required by other structures of this type.

Although the presently preferred embodiment of mine seal 10 satisfies all Federal requirements, variations of the seal design are possible. The gravel used as the filler material may be replaced with another material which provides equivalent strength and void space for the binding material. Examples of such filler material include No. 57 limestone, talc, glass bubble microspheres, and other extenders. Such fillers do not substantially affect the behavior of the polyurethane or plastic binding material.

In addition, the concrete-block walls 12 and 14 may be replaced with walls of other construction which meet the MSHA requirement of ASTM 119 or equivalent fire resistance. Alternatively, concrete block walls 12 and 14 may be modified by the addition of pilasters or other structural features to increase the structural strength of mine seal 10. Finally, mechanical anchors into the mine opening may be used to provide additional structural strength to seal 10.

In an alternative method to form mine seal 10, concrete block walls 12 and 14 are constructed simultaneously. Gaps are provided in wall 14 to provide an entry for the binding material to be injected. A mixture of binding material 18 and filler material 16 is injected through the gaps provided in wall 14. Once the space between walls 12 and 14 is filled, the gaps in wall 14 are closed and a sealant 26 is provided on the outer surface of wall 14.

Figure 2:
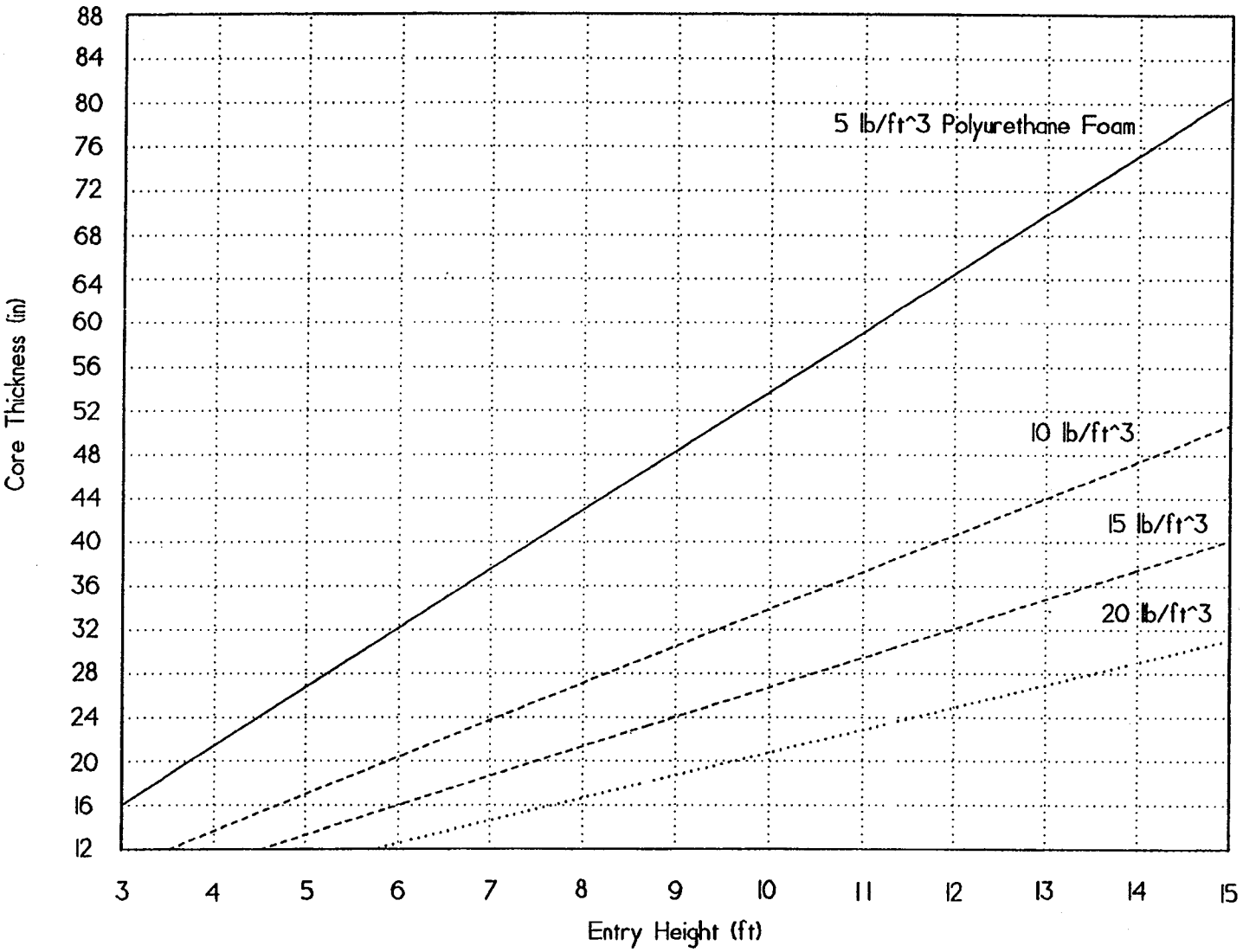
FIG. 2 is a graph showing the required core thickness of a polyurethane foam binder as a function of the entry height for different density polyurethane foams.

In an alternative mine seal, the binding material is used alone without a filler material. FIG. 2 shows the depth of a polyurethane foam binding material required for various density foams as a function of the mine entry height. It has been found that the 5 lb./ft.$^3$ density polyurethane foam provides a cost-effective binding material.

Extensive references to polyurethane foams have been made in this specification. It is to be distinctly understood that other plastic materials may also be used as suitable binding materials.

In the foregoing specification certain preferred practices and embodiments of this invention have been set out, however, it will be understood the the invention may be otherwise embodied within the scope of the following claims.

We claim:

1. An explosion-proof mine seal comprising a pair of walls constructed across a mine entry, and a filler material composition saturated with a closed-cell polyurethane foam binding material provided between said walls, said binding material adhering each of said walls to the filler material composition and adhering the filler material composition to the floor, roof and ribs of the mine entry.

2. The mine seal of claim 1 wherein said walls are formed of concrete block.

3. The mine seal of claim 2 wherein the outside surface of each of said walls is coated with a sealant.

4. The mine seal of claim 1 wherein said filler material is gravel.

5. An explosion-proof mine seal comprising a pair of walls constructed across a mine entry, and a closed-cell polyurethane foam binding material provided between said walls, and said binding material adhering to each of said walls and to the floor, roof and ribs of the mine entry.

6. The mine seal of claim 5 wherein said walls are formed of concrete block.

7. The mine seal of claim 6 wherein the outside surface of each of said walls is coated with a sealant.

* * * * *